US007121223B1

(12) United States Patent
Whitener

(10) Patent No.: US 7,121,223 B1
(45) Date of Patent: Oct. 17, 2006

(54) ANCHOR

(76) Inventor: Leonard P. Whitener, 816 Roy Layne Rd., Lebanon Junction, KY (US) 40150-8038

( * ) Notice: Subject to any disclaimer, the term of this patent is extended or adjusted under 35 U.S.C. 154(b) by 33 days.

(21) Appl. No.: 10/980,492

(22) Filed: Nov. 3, 2004

(51) Int. Cl.
*B63B 21/24* (2006.01)

(52) U.S. Cl. ..... 114/294

(58) Field of Classification Search ..... 114/294, 114/300, 297, 299
See application file for complete search history.

(56) References Cited

U.S. PATENT DOCUMENTS 3,076,283 A * 2/1963 Luketa ..... 43/43.1
4,224,892 A * 9/1980 Sandberg ..... 114/294
4,383,493 A 5/1983 Takamatsu et al.
4,409,923 A 10/1983 MacPherson
5,005,508 A 4/1991 Crosby et al.
5,975,001 A 11/1999 Verrier
6,098,565 A 8/2000 O'Neil, Sr. et al.

* cited by examiner

*Primary Examiner*—Sherman Basinger
(74) *Attorney, Agent, or Firm*—Krieg DeVault LLP

(57) ABSTRACT

An anchor having a hollow body, curved sides, and weighted ends. The anchor is attached to an anchor rode by a curved rod extending between the ends on which an anchor rode shackle or thimble may be connected for movement end to end.

19 Claims, 3 Drawing Sheets

ANCHOR

DESCRIPTION OF SPECIFIC EMBODIMENTS

Figure 1:
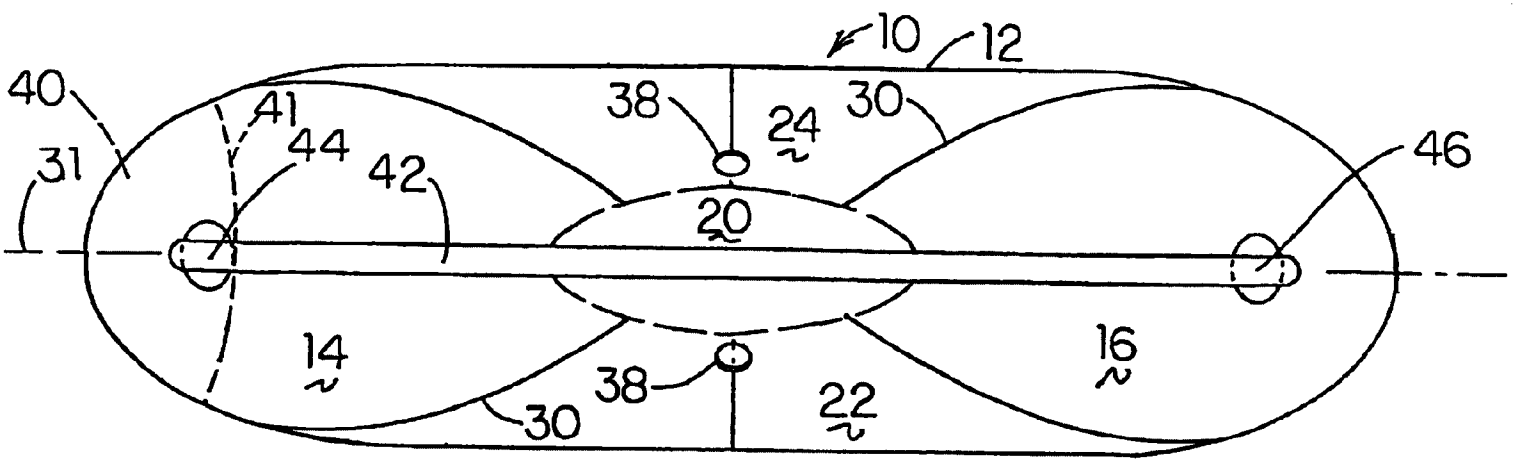
FIG. 1 is a top view of the new and improved anchor of the invention.

The new and improved anchor 10 of the invention comprises a body 12 having opposite ends 14 and 16, a bottom 18, a top 20, and opposite sides 22 and 24.

The body 12 can be described as being part cylindrical having cross-sections taken substantially perpendicular of the bottom 18 being generally part circular. However, other versions of body 12 may have cross-sections which are part elliptical with major and minor diameters which could extend between the top and bottom and transversely between the top and bottom 18, 20 and transversely thereof between the opposite sides 22, 24. In other versions, body 12 is not generally cylindrical or elliptical, but is curved. In all versions, sides 22, 24 and bottom 18 are smoothly curvilinear surfaces continuously curved between opposite sides of top 20.

Figure 2:
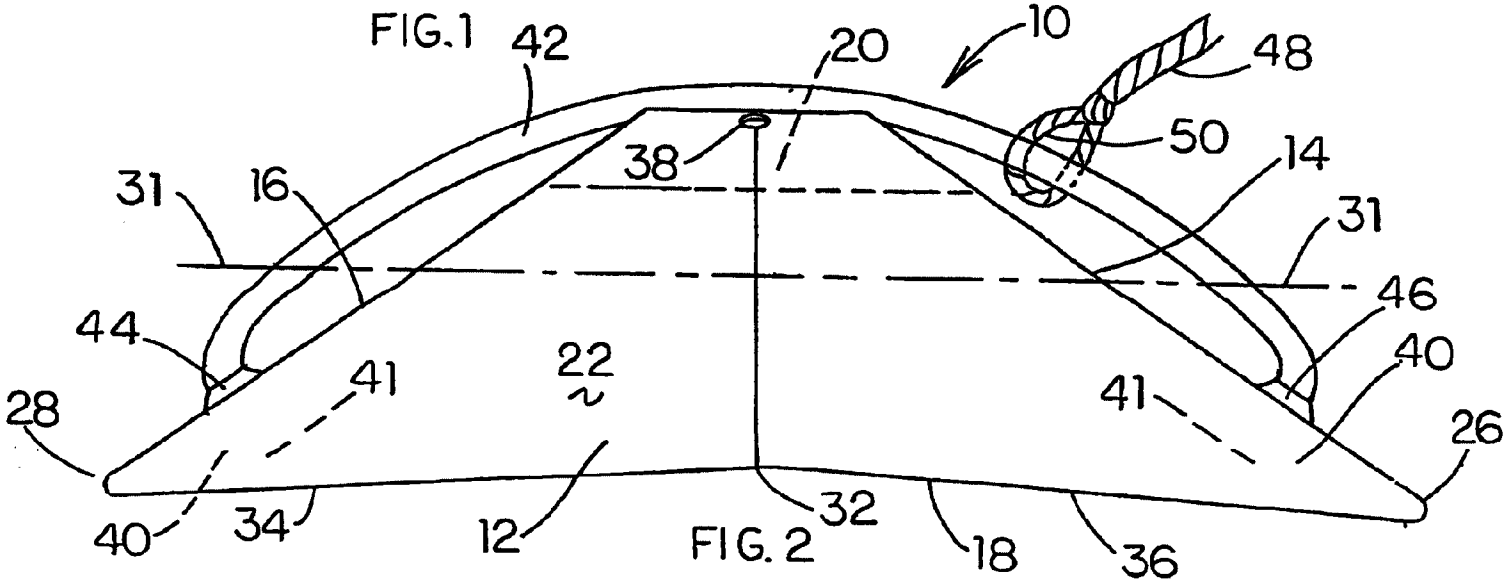
FIG. 2 is a side view of the new and improved anchor of the invention.

In contrast, ends 14 and 16 are generally planar. Ends 14 and 16 extend planarly upwardly from bottom 18 to top 20. Ends 14 and 16 angularly extend inwardly toward each other as best shown in FIG. 2. Ends 14 and 16 define with bottom 18 opposite pointed end extremities 26 and 28. An angle of 25° to 45° is defined by the pointed end extremities 26 and 28 or tips. Because of the curvature of sides 22, 24 and bottom 18, ends 14 and 16 have a curvilinear periphery 30 where ends 14 and 16 contact sides 22, 24 and bottom 18. See FIG. 1.

Figure 4:
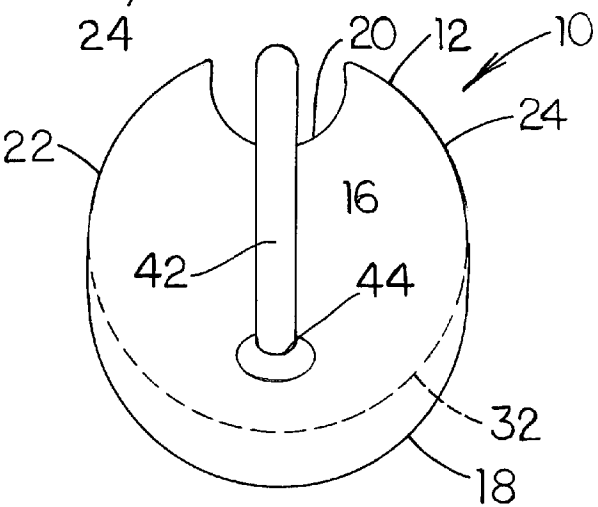
FIG. 4 is an end view of the new and improved anchor of the invention.
Figure 5:
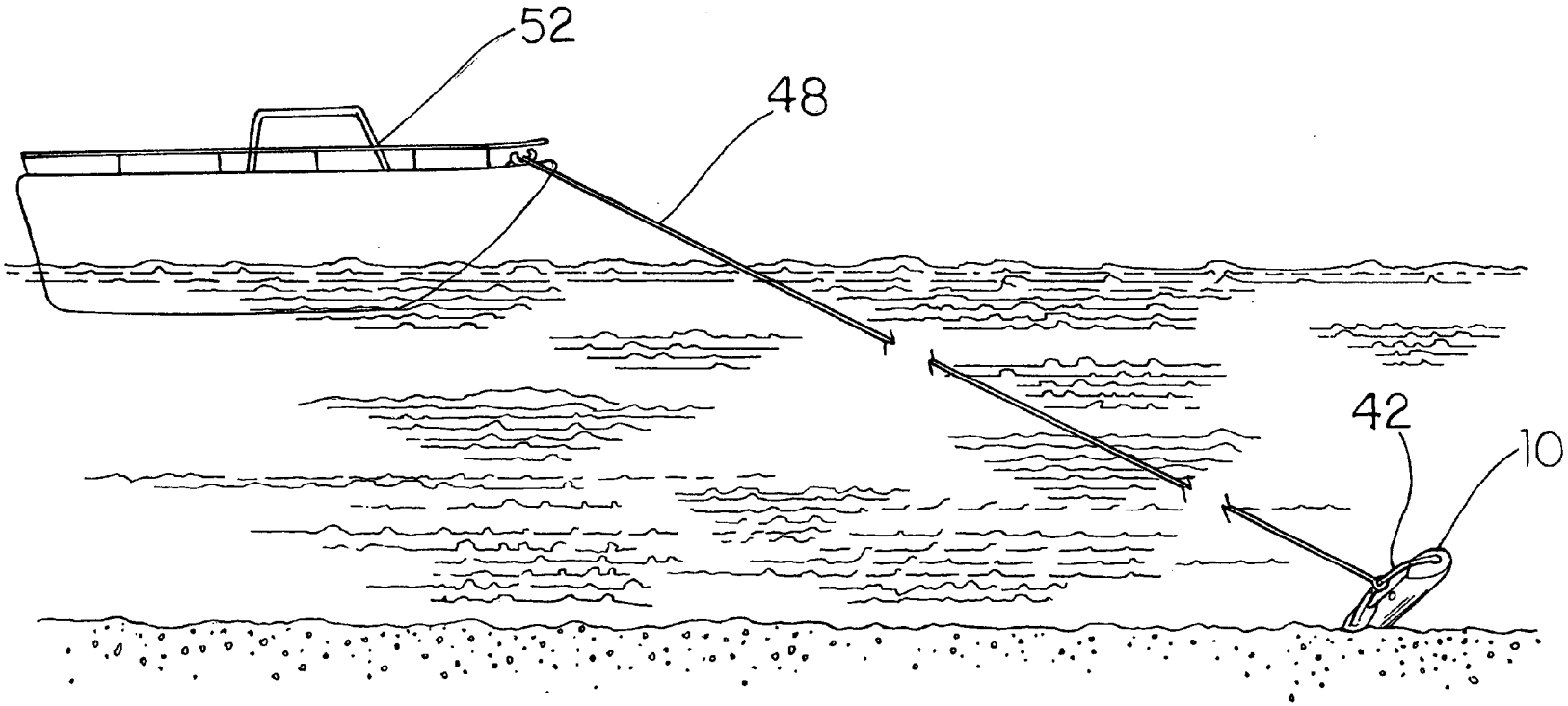
FIG. 5 is a view of the new and improved anchor of the invention in use.

Top 20 is shown in FIG. 4 as being curvilinear. In one version, top 20 is cylindrical with an axis extending generally parallel to a center line 31. In other versions, top 20 may have a curved surface of any geometric configuration about an axis generally parallel to center line 31. In still other versions, top 20 may, in cross-sections, have any other geometrical configuration including generally flat surfaces and generally curved surfaces so long as top 20 extends downwardly toward the center line 31 from top 20's mergence with opposite sides 22 and 24 and does not have any corners that are not rounded sufficiently so as not to collect sand and other debris. See FIG. 4.

Bottom 18 is also curved. However, bottom 18 is divided into two substantially equal portions 34, 36 by a seam 32 which extends between opposite extremities 26 and 28 generally midway therebetween. Seam 32 is closer to center line 32 than extremities 26 and 28 such that bottom 18 slopes inwardly of body 12 from its extremities as shown in FIG. 2. An angle of 4° and 12° is defined between the bottom 18 and the horizontal on opposite sides of the seam 32. The seam 32 is about 32 inches in length and is raised about 1 inch from a plane including the pointed end extremities 26 and 27 or tips. Seam 32 divides bottom 18 into two portions 34 and 36, the surfaces of both being generally curved as above described and as shown in FIG. 4.

Figure 3:
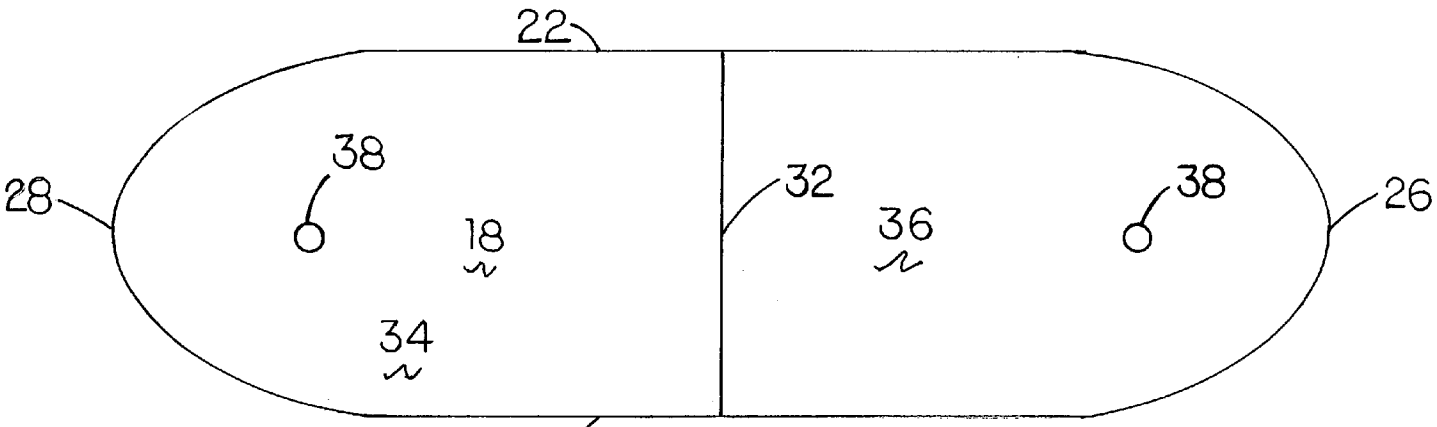
FIG. 3 is a bottom view of the new and improved anchor of the invention.

Body 12 is hollow and is provided with drainage holes 38 in the bottom 18 midway between seam 32 and extremities 26 and 28 as shown in FIG. 3. Additional drainage holes 38 are positioned in sides 22 and 24 adjacent top 20 as shown in FIGS. 1 and 2.

Body 12 is weighted adjacent extremities 26 and 28. Weights 40 may take a number of different forms. Weights 40, in one embodiment, may be lead or concrete or another weighted material filling the volume of the extremities 26 and 28 between the periphery 30 and the dashed line 41 indicated in FIGS. 1–3. Weights 40 may also be shot of any heavy material adhesively secured in the same position and in substantially the same volume. In other embodiments, other weighted materials can be positioned adjacent extremities 26 and 28. In all embodiments, the weights 40 of extremities 26 and 28 should be greater than about 15 pounds and less than about 25 pounds.

A smoothly curved retention slide bar 42 is secured at its opposite ends adjacent extremities 26, 28. Slide bar 42 has opposite ends 44 and 46. Ends 44 and 46 are secured to the body 12 adjacent extremities 26 and 28. Slide bar 42 extends from adjacent ends 26 and 28 axially of the body 12 over the top 20 as shown in FIGS. 1, 2 and 4. Slide bar 42 is smoothly curved from end 44 to end 46. The curvature of slide bar 42, in specific embodiments, need not be radiused, but always must be smoothly curved. In various embodiments, slide bar 42 may be a combination of radii along its length, or may be parabolicly or otherwise curved. Slide bar 42 is attached to the anchor rode 48. The most common method of attaching the anchor rode 48 to the slide bar 42 is to splice an eye around a thimble in the end of the rode and then shackle the thimble 50 to the slide bar 42. Preferably, the thimble 50 is smoothly curved such that the thimble and the anchor rode 48 attached to it can easily slide along the slide bar from end to end with minimal friction. In one embodiment, the opposite ends of the slide bar 42 are secured to the weighted ends adjacent extremities 26 and 28. This allows the slide bar 42 to be secured to a portion of the anchor that will not deform under the stresses resulting from the force applied to the anchor rode 48. In other embodiments, adequate securance of the slide bar 42 can be provided by merely forming the body 12 of sufficiently thick gauge metal material such that the slide bar is secured in the same or similar fashion.

In a specific embodiment, the anchor 10 useable for vessels weighing from about 35,000 pounds to about 80,000 pounds measures from extremity 26 to extremity 28 about 32 inches. The body 12 has girth measured about seam 32 of about 29 inches. The drainage holes 38 are each about ⅝ inches in diameter. The slide bar 42 is approximately 28 inches long. In all embodiments, the angle defined by the bottom 18 with the horizontal is between about 10 and about 12 degrees. The angle defined between the bottom 18 and the sides 14 and 16 at each extremity 26 and 28 is between about 30 and about 35 degrees, typically about 32 degrees.

In operation, the anchor 10 is secured to the vessel by the anchor rode 48 extending between the slide bar 42 and a cleat on a vessel 52. The anchor scope, as with other anchors, should vary between a minimum of about 5 to 1 for calm seas to a maximum of about 10 to 1 in more severe conditions. The anchor 10 is lowered over the bow of the vessel 52 and the vessel 52 is allowed to drift with the wind or current or with reversed engines at idle if necessary while the rode is paid out slowly so that it does not plow the anchor 10. When sufficient rode 48 is out, a gradual strain should be taken on the rode 48 to allow the anchor 10 to set or dig in. After snubbing, the rode 48 should be pulled firmly to determine if the anchor 10 is set or dragging.

When strain is taken on the rode 48, the anchor 10 will set into almost any bottom configuration, whether it is mud, sand, rock, gravel, weeds, or any combination thereof. Because of the weights 40 at the extremities 26 and 28, one of the extremities 26, 28 will dig into the bottom. When strain is applied to the rode 48, the shackle or thimble 50 moves to one end of the slide bar 42 or the other, depending on which direction the strain is applied and the extremity 26, 28 adjacent that end of slide bar 42 digs into the bottom. Additional pulling on the anchor merely increases the dig-in in all instances locking the anchor 10 to the bottom.

When ready to hoist the anchor 10, the anchor is approached at slow vessel speed until the vessel 52 is in a vertical position over the anchor 10. As the vessel 52 approaches the anchor 10, the rode 48 is taken in to avoid fouling. Once the vessel 52 is over the anchor 10, the shackle 50 will be positioned over the top 20 of the anchor 10 and the anchor 10 should break out of the bottom easily and be raised to be positioned on the deck. Usually, it is not necessary to tie a trip line to the anchor 10.

The unique structure of the anchor 10 allows the anchor 10 to function as above described. The angle of the bottom 18 means that any motion of the anchor to the left or right as illustrated in FIG. 2, will embed one of the extremities 26, 28 into the bottom as desired. The weights 40 and the angle of the bottom 18 ensure that the anchor will dig in. It has been found that any angle less than 35 degrees allows the anchor to dig in relatively easily. Angles greater than 45 degrees pose problems inasmuch as the anchor is more than likely to rotate about one of the extremities 26, 28 rather than to dig in.

The anchor of the invention is uniquely constructed so as to hold vessels 52 of 2,000 pounds to 65,000 pounds and up in all types of bottom configurations. Because the opposite ends of the anchor 10 are geometrically similar, and the rode 48 is freely movable from end to end of the slide bar 42, the anchor 10 will maintain its hold when the stress on the rode 48 is applied in all 360 degrees about the anchor 10 once it is set. An anchor 10 of the dimensions above has been used in vessels weighing 65,000 pounds and above on a sandy bottom in winds of 45 miles per hour without failure.

While several versions have been disclosed herein, it is to be understood that the versions and variations shown and described are merely illustrative of the principals of the invention and that various modifications may be implemented by those skilled in the art without departing from the scope and spirit of the invention and the claims appended thereto:

What is claimed is:

1. An anchor comprising a body, said body having a top and bottom and opposite sides and ends, said body being hollow, said top being smaller than said bottom, said sides extending between said top and bottom and ends, said sides being curved outwardly about one or more radii extending between said ends, said ends being generally planar, said bottom having a seam extending transversely of said body between said sides and spaced from said ends, said bottom being curved between said seam and said ends, said ends defining angular tips with said bottom, and a curved rod extending between said ends and over said top on which an anchor rode may be connected for travel end to end.

2. The anchor of claim 1 wherein said body has a plurality of holes therein.

3. The anchor of claim 2 wherein said opposite angular tips being filled with a material heavier than water.

4. The anchor of claim 3 wherein said material being chosen from the group of weighted materials consisting of lead, concrete, shot, or combinations thereof.

5. The anchor of claim 4 wherein said tips define angles between 25 degrees and 45 degrees.

6. The anchor of claim 4 wherein said curved rod being radiused.

7. The anchor of claim 6 wherein said bottom on opposite sides of said seam define an angle between 4 degrees and 12 degrees.

8. The anchor of claim 7 wherein said top defines a curved surface extending toward said bottom, said curved surface being at all places spaced from said curved rod.

9. The anchor of claim 8 wherein said curved rod is radiused, and further comprising a clevis extending around said rod, said clevis moveable from end to end upon any urging upon the clevis with equal resistance throughout the length of said rod.

10. The anchor of claim 1 wherein said opposite angular tips are filled with a material heavier than water.

11. The anchor of claim 1 wherein said opposite angular tips are filled with weighted material chosen from the group of weighted materials consisting of lead, concrete, shot, or combinations thereof.

12. The anchor of claim 1 wherein said tips define angles between 25 degrees and 45 degrees.

13. The anchor of claim 12 wherein said tips define an angle between 30 degrees and 35 degrees.

14. The anchor of claim 1 wherein said curved rod is radiused.

15. The anchor of claim 1 wherein said bottom on opposite sides of said seam define an angle with the horizontal between about 4 degrees and about 12 degrees.

16. The anchor of claim 1 wherein said seam of anchor measuring about 32 inches long is raised from the plane including said opposite tips about 1 inch.

17. The anchor of claim 1 wherein said top is radiused inwardly of said body toward said bottom around a longitudinal axis extending end to end.

18. The anchor of claim 1 wherein the top defines a curved surface extending toward said bottom, said curved surface being at all places spaced from said curved rod.

19. The anchor of claim 1 wherein said curved rod is radiused, and further comprising a clevis extending around said rod, said clevis being moveable from end to end upon any urging upon the clevis with equal resistance throughout the length of said rod.

* * * * *

UNITED STATES PATENT AND TRADEMARK OFFICE

CERTIFICATE OF CORRECTION

PATENT NO. : 7,121,223 B1
APPLICATION NO. : 10/980492
DATED : October 17, 2006
INVENTOR(S) : Leonard P. Whitener It is certified that error appears in the above--identified patent and that said Letters Patent is hereby corrected as shown below:

Col. 4 Claim 3, line 1, “2” should be --1--

Col. 4 Claim 3, line 2, “being” should be --are--

Col. 4 Claim 4, line 1, “3” should be --1--

Col. 4 Claim 4, line 1, insert the phrase --opposite angular tips are filled with weighted-- after the word “said”

Col. 4 Claim 4, line 1, delete the word “being”

Col. 4 Claim 5, line 1, “4” should be --1--

Col. 4 Claim 6, line 1, “4” should be --5--

Col. 4 Claim 6, line 1, insert the phrase --tips define an angle between 30 degrees and 35 degrees-- after the word “said”

Col. 4 Claim 6, lines 1-2, delete the phrase “curved rod being radiused”

Col. 4 Claim 7, line 1, “6” should be --1--

Col. 4 Claim 7, line 1, insert the phrase --curved rod is radiused-- after the word “said”

Col. 4 Claim 7, lines 1-3, delete the phrase “bottom on opposite sides of said seam define an angle between 4 degrees and 12 degrees”

Col. 4 Claim 8, line 1, “7” should be --1--

Col. 4 Claim 8, line 1, insert the phrase --bottom on opposite sides of said seam define an angle with the horizontal between about 4 degrees and about 12 degrees-- after the word “said”

Col. 4 Claim 8, lines 1-3, delete the phrase “top defines a curved surface extending toward said bottom, said curved surface being at all places spaced from said curved rod”

Col. 4 Claim 9, line 1, “8” should be --1--

Col. 4 Claim 9, line 1, insert the phrase --seam of anchor measuring about 32 inches long is raised from the plane including said opposite tips about 1 inch-- after the word “said”

UNITED STATES PATENT AND TRADEMARK OFFICE

CERTIFICATE OF CORRECTION

PATENT NO. : 7,121,223 B1
APPLICATION NO. : 10/980492
DATED : October 17, 2006
INVENTOR(S) : Leonard P. Whitener It is certified that error appears in the above--identified patent and that said Letters Patent is hereby corrected as shown below:

Col. 4 Claim 9, lines 1-5, delete the phrase "curved rod is radiused, and further comprising a clevis extending around said rod, said clevis moveable from end to end upon any uring upon the celvis with equal resistance throughout the length of said rod"

Col. 4 Claim 10, line 1, insert the phrase --top is radiused inwardly of said body toward said bottom around a longitudinal axis extending end to end-- after the word "said"

Col. 4 Claim 10, lines 1-2, delete the phrase "opposite angular tips are filled with a material heavier than water"

Col. 4 Claim 11, line 1, insert the phrase --the top defines a curved surface extending toward said bottom, said curved surface being at all places spaced from said curved rod-- after the word "wherein"

Col. 4 Claim 11, lines 1-4, delete the phrase "said opposite angular tips are filled with weighted material chosen from the group of weighted materials consisting of lead, concrete, shot, or combinations thereof"

Col. 4 Claim 12, line 1, insert the phrase --curved rod is radiused, and further comprising a clevis extending around said rod, said clevis being moveable from end to end upon any urging upon the clevis with equal resistance throughout the length of said rod-- after the word "said"

Col. 4 Claim 12, lines 1-2, delete the phrase "tips define angles between 25 degrees and 45 degrees"

Col. 4 Claim 13, line 1, "12" should be --2--

Col. 4 Claim 13, line 1, insert the phrase --opposite angular tips being filled with a material heavier than water-- after the word "said"

Col. 4 Claim 13, lines 1-2, delete the phrase "tips define an angle between 30 degrees and 35 degrees"

Col. 4 Claim 14, line 1, "1" should be --13--

Col. 4 Claim 14, line 1, insert the phrase --material being chosen from the group of weighted materials consisting of lead, concrete, shot, or combinations thereof-- after the word "said"

UNITED STATES PATENT AND TRADEMARK OFFICE

CERTIFICATE OF CORRECTION

PATENT NO. : 7,121,223 B1
APPLICATION NO. : 10/980492
DATED : October 17, 2006
INVENTOR(S) : Leonard P. Whitener It is certified that error appears in the above--identified patent and that said Letters Patent is hereby corrected as shown below:

Col. 4 Claim 14, lines 1-2, delete the phrase "curved rod is radiused"

Col. 4 Claim 15, line 1, "1" should be --14--

Col. 4 Claim 15, line 1, insert the phrase --tips define angles between 25 degrees and 45 degrees-- after the word "said"

Col. 4 Claim 15, lines 1-3, delete the phrase "bottom on opposite sides of said seam define an angle with the horizontal between about 4 degrees and about 12 degrees"

Col. 4 Claim 16, line 1, "1" should be --14--

Col. 4 Claim 16, line 1, insert the phrase --curved rod being radiused-- after the word "said"

Col. 4 Claim 16, lines 1-3, delete the phrase "seam of anchor measuring about 32 inches long is raised from the plane including said opposite tips about 1 inch"

Col. 4 Claim 17, line 1, "1" should be --16--

Col. 4 Claim 17, line 1, insert the phrase --bottom on opposite sides of said seam define an angle between 4 degrees and 12 degrees-- after the word "said"

Col. 4 Claim 17, lines 1-3, delete the phrase "top is radiused inwardly of said body toward said bottom around a longitudinal axis extending end to end"

Col. 4 Claim 18, line 1, "1" should be --17--

Col. 4 Claim 18, line 1, "the" should be --said--

UNITED STATES PATENT AND TRADEMARK OFFICE

CERTIFICATE OF CORRECTION

PATENT NO. : 7,121,223 B1
APPLICATION NO. : 10/980492
DATED : October 17, 2006
INVENTOR(S) : Leonard P. Whitener It is certified that error appears in the above--identified patent and that said Letters Patent is hereby corrected as shown below:

Col. 4 Claim 19, line 1, "1" should be --18--

Signed and Sealed this

First Day of May, 2007

JON W. DUDAS
*Director of the United States Patent and Trademark Office*